US009468245B2

(12) United States Patent
Woods

(10) Patent No.: US 9,468,245 B2
(45) Date of Patent: Oct. 18, 2016

(54) REUSABLE EYELASHES

(71) Applicant: Deangela Carter Woods, El Cerrito, CA (US)

(72) Inventor: Deangela Carter Woods, El Cerrito, CA (US)

(73) Assignee: Deangela C. Woods, Las Vegas, NV (US)

( * ) Notice: Subject to any disclaimer, the term of this patent is extended or adjusted under 35 U.S.C. 154(b) by 0 days.

(21) Appl. No.: 14/643,513

(22) Filed: Mar. 10, 2015

(65) Prior Publication Data

US 2015/0250243 A1 Sep. 10, 2015

Related U.S. Application Data

(60) Provisional application No. 61/950,557, filed on Mar. 10, 2014.

(51) Int. Cl.
*A41G 5/02* (2006.01)

(52) U.S. Cl.
CPC ..... *A41G 5/02* (2013.01)

(58) Field of Classification Search
CPC .. A41G 3/0008; A41G 3/0025; A41G 3/005; A41G 5/00; A41G 5/02; A41G 5/0013; A41G 5/0033; A41G 5/004; A41G 5/0053; A41G 5/008
USPC ..... 132/53–56, 201, 216
See application file for complete search history.

(56) References Cited

U.S. PATENT DOCUMENTS

| | | | | | |
|---|---|---|---|---|---|
| 994,619 | A * | 6/1911 | Taylor | A41G 3/00 | 132/53 |
| 1,450,259 | A * | 4/1923 | Nessler | A41G 5/02 | 132/201 |
| 3,315,689 | A * | 4/1967 | Melik | A41G 5/02 | 132/317 |
| 3,447,542 | A * | 6/1969 | McCullough | A41G 5/02 | 132/53 |
| 6,029,674 | A * | 2/2000 | Han | A41G 5/02 | 132/216 |
| 8,061,367 | B2 * | 11/2011 | Rabe | A41G 5/02 | 132/216 |
| 8,347,896 | B2 * | 1/2013 | Liao | A41G 5/02 | 132/201 |
| 2002/0056465 | A1 * | 5/2002 | Shin | A41G 5/02 | 132/53 |
| 2003/0005941 | A1 * | 1/2003 | Iosilevich | A41G 5/02 | 132/53 |
| 2007/0227550 | A1 * | 10/2007 | Merszei | A41G 5/02 | 132/53 |
| 2008/0257369 | A1 * | 10/2008 | Poole | A41G 5/004 | 132/53 |
| 2012/0180804 | A1 * | 7/2012 | Hochi | A41G 5/02 | 132/53 |

* cited by examiner

*Primary Examiner* — Rachel Steitz

(57) ABSTRACT

A reusable eyelash includes an eyelash and a monofilament lace attachment strip. The eyelash is adjacently connected on a top surface of the monofilament lace attachment strip, where a bottom surface of the monofilament lace attachment strip is attached onto an eyelid through an adhesive layer. The adhesive layer of the reusable eyelash can be a user applied adhesive liquid or a pre-manufactured adhesive strip while the monofilament lace attachment strip is a formfitting material that can match the contour of the eyelid in order to create a natural appearance.

14 Claims, 5 Drawing Sheets

DETAIL C
SCALE 4 : 1.5

REUSABLE EYELASHES

The current application claims a priority to the U.S. Provisional Patent application Ser. No. 61/950,557 filed on Mar. 10, 2014.

FIELD OF THE INVENTION

The present invention relates generally to an apparatus for enhancing eyelashes. More specifically, the present invention is a reusable eyelash that attaches to the eyelid with an adhesive layer.

BACKGROUND OF THE INVENTION

Eyelashes generally grow at the edge of the eyelid so that the eye can be protected from debris. More specifically, the eyelashes perform as sensor for the eye, thus providing a warning that an object is near the eye. Even though the eyelashes are present to protect the eye, the eyelashes also considered as a sign of beauty. As a result, synthetic eyelashes extensions are commonly used in the cosmetic industry to enhance the natural eyelash length. The synthetic eyelashes extensions, which presently exist in the cosmetic industry, are considered disposable since the synthetic eyelashes extensions cannot be worn more than once. The existing synthetic eyelashes extensions are typically affixed directly to the natural eyelashes through an adhesive material that is present on the synthetic eyelashes extensions. Once the synthetic eyelashes extensions are removed, they cannot be worn again as the adhesive properties of the adhesive material diminish.

It is an objective of the present invention to provide a reusable eyelashes that can be worn multiple times as the reusable eyelashes are adhered to the eyelids through an adhesive layer of a monofilament lace attachment strip. Additionally, the monofilament lace attachment strip in combination with the adhesive layer allows the users to optimize the usage of the reusable eyelashes.

DETAIL DESCRIPTIONS OF THE INVENTION

All illustrations of the drawings are for the purpose of describing selected versions of the present invention and are not intended to limit the scope of the present invention.

Figure 1:
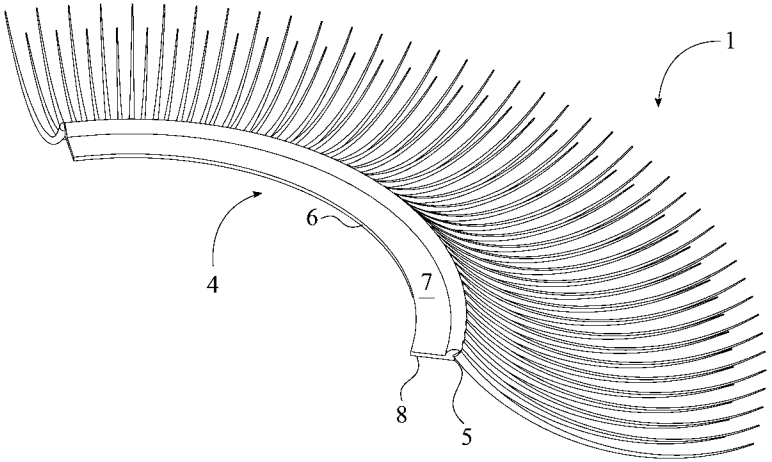
FIG. 1 is a top perspective view of the present invention.

The present invention is a reusable eyelash that can be attached to the eyelids with an adhesive. The present invention provides a unique way of enhancing the sign of beauty with less time consuming and convenient apparatus while still maintaining the beauty of the eye. In reference to FIG. 1-FIG. 3, the present invention comprises an eyelash 1, a monofilament lace attachment strip 4, and an adhesive layer 9, where the eyelash 1 is firmly connected to the monofilament lace attachment strip 4. The monofilament lace attachment strip 4 allows the users to comfortably place the eyelash 1 or easily remove the eyelash 1 themselves in a matter of minutes with the adhesive layer 9 while the monofilament lace attachment strip 4 in combination with the adhesive layer 9 enable the present invention to be worn multiple times.

Figure 2:
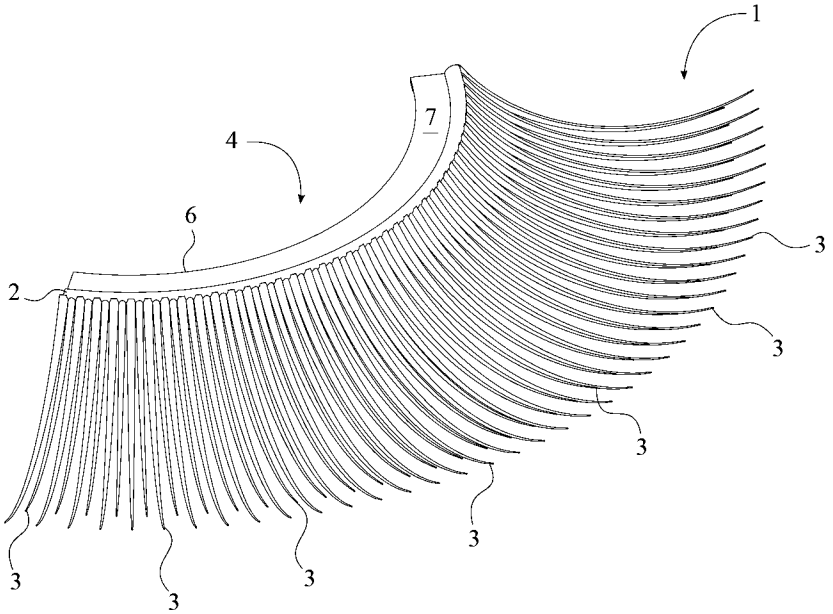
FIG. 2 is another top perspective view of the present invention.

The eyelash 1 that enhances the sign of beauty around the eye comprises a base strip 2 and a plurality of curl lashes 3 as shown in FIG. 2. The plurality of curl lashes 3 is extended along the base strip 2 and is radially extended from the base strip 2. The base strip 2 is generally sized to fit the dimensions of the eyelid so that the base strip 2 can be placed adjacent to the edge of the eyelid. The plurality of curl lashes 3 can vary in thickness, length, and the curl shape so that the present invention is able to provide different embodiments of the present invention to meet different consumer demands. For example, the curl shape of the plurality of curl lashes 3 can include, but not limited to, J-curl, B-curl, C-curl, D-curl while the thickness and the length can also change upon the different consumer demands. The plurality of curl lashes 3 is also organized according to different styles so that the present invention can attract wider range of consumers. For example, the plurality of curl lashes 3 can be oriented according to different styles such as, classic lash style, basic lash style, full lash style, and other forms of styles that exist in the cosmetic industry.

The monofilament lace attachment strip 4 is a thin and breathable lace material which gives the illusion of skin natural color. More specifically, the monofilament lace attachment strip 4 of the present invention ranges in different skin tones so that the present invention is able to match different skin tones of the consumers. The monofilament lace attachment strip 4 gives the illusion that the plurality of curl lashes 3 is growing directly out of the edge of the eyelid, thus making it virtually undetectable. In reference to FIG. 1 and FIG. 2, the monofilament lace attachment strip 4 comprises a front edge 5, a rear edge 6, a top surface 7, and a bottom surface 8 as the front edge 5 and the rear edge 6 are oppositely positioned of each other along the monofilament lace attachment strip 4. The top surface 7 is oriented in between the front edge 5 and the rear edge 6 while the bottom surface 8 is oriented in between the front edge 5 and rear edge 6 opposite of the top surface 7. The monofilament lace attachment strip 4 is preferably made from a formfitting material so that the monofilament lace attachment strip 4 is able to match the contour of the eyelid creating natural appearance.

Figure 3:
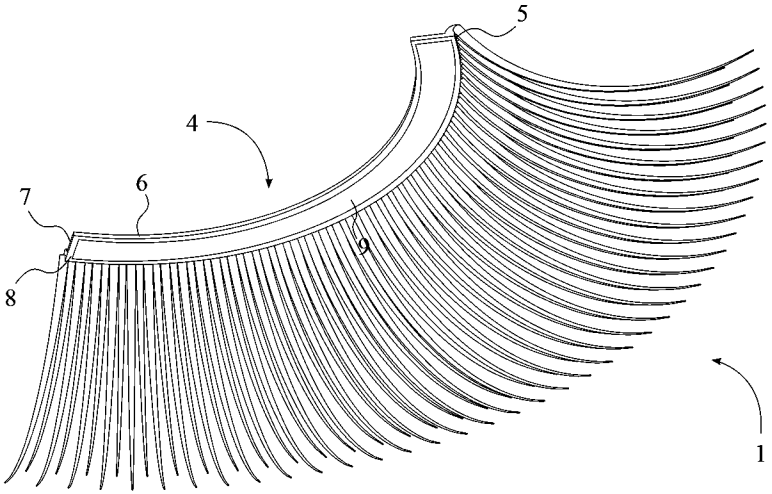
FIG. 3 is a bottom perspective view of the present invention.
Figure 4:
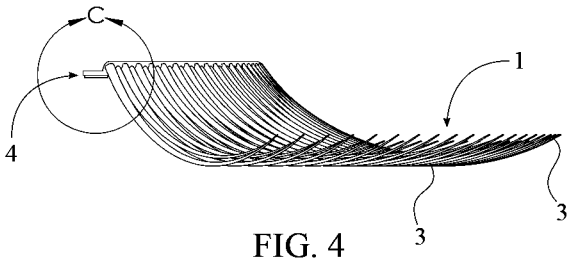
FIG. 4 is a side view of the present invention, wherein a detail view C is shown in FIG. 5.
Figure 5:
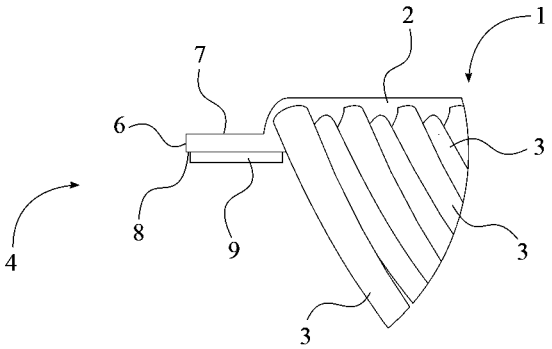
FIG. 5 is a detail view of the base spring of the present invention illustrating the position of the adhesive layer of the present invention.

In reference to FIG. 3-FIG. 5, the eyelash 1 is adjacently mounted on the top surface 7 of monofilament lace attachment strip 4 as the adhesive layer 9 is superimposed onto the bottom surface 8 opposite of the eyelash 1. More specifically, the base strip 2 is perimetrically connected along the top surface 7 of the monofilament lace attachment strip 4 in such a way that the base strip 2 is adjacently positioned with the front edge 5. The present invention creates a smooth connection between the eyelash 1 and the top surface 7 in order to create the illusion of natural growth so that the present invention can easily blend with the natural eyelashes of the users.

Figure 6:
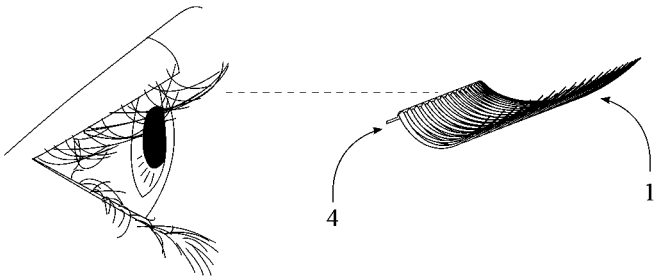
FIG. 6 is a side view showing an eye before the present invention is adhered onto the eyelid.
Figure 7:
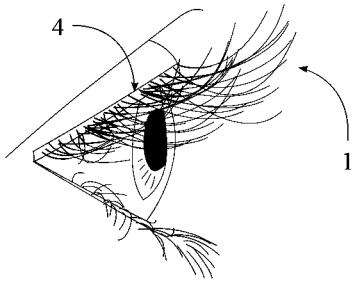
FIG. 7 is a side view showing the eye after the present invention is adhered onto the eyelid.

In reference to FIG. 6 and FIG. 7, the adhesive layer 9 of the present invention comprises two different configurations, where one does not precede the other. A first configuration of the adhesive layer 9 is a user applied adhesive liquid, where the adhesive liquid is applied along the bottom surface 8. Then the base strip 2 is adjacently positioned with the edge of the eyelid and the monofilament lace attachment strip 4 is adhered onto the eyelid through the user applied adhesive liquid. A second configuration of the adhesive layer 9 is a pre-manufactured adhesive strip, where the adhesive strip is positioned along the bottom surface 8 and covered with a removable film. In order to utilize the adhesive strip, the users first have to peel off the removable film away from the adhesive strip. Then the base strip 2 is adjacently positioned with the edge of the eyelid and the monofilament lace attachment strip 4 is adhered onto the eyelid through the adhesive strip. The adhesive layer 9 in reference to the first configuration and the second configuration provides the same functionality as the plurality of curl lashes 3 is able to blend with the natural eyelashes of the users creating a complete and beautiful eyelash 1 arrangement.

The present invention can be utilized with the cosmetic applications so that the present invention provides a solution for disposable eyelashes attachment. Most eyelash attachments cannot be reused after the initial usage because a type of glue or an adhesive strip positioned on the edge strip deforms and damages the edge strip and curl lashes of the eyelash attachment. However, since the adhesive layer 9 of the present invention is positioned in between the eyelid and the monofilament lace attachment strip 4, the base strip 2 and the plurality of curl lashes 3 of the present invention do not get damage or deform during the multiple usage of the present invention. As a result, the present invention is able to provide reusable eyelashes for consumers of the present invention.

Although the invention has been explained in relation to its preferred embodiment, it is to be understood that many other possible modifications and variations can be made without departing from the spirit and scope of the invention as hereinafter claimed.

What is claimed is:

1. A reusable eyelash comprises:
an eyelash;
a monofilament lace attachment strip;
an adhesive layer;
the eyelash comprises a base strip and a plurality of curl lashes;
the monofilament lace attachment strip comprises a front edge, a rear edge, a top surface, and a bottom surface;
the eyelash being adjacently mounted on the top surface;
the adhesive layer being superimposed onto the bottom surface opposite of the eyelash;
the plurality of curl lashes being extended along the base strip;
the plurality of curl lashes being radially extended from the base strip;
the front edge and the rear edge being oppositely positioned of each other along the monofilament lace attachment strip;
the top surface being oriented between the front edge and the rear edge;
the bottom surface being oriented between the front edge and the rear edge opposite of the top surface;
the base strip being perimetrically connected along the monofilament lace attachment strip; and
the base strip being adjacently positioned with the front edge.

2. The reusable eyelash as claimed in claim 1, wherein the monofilament lace attachment strip is a formfitting material.

3. The reusable eyelash as claimed in claim 1, wherein the adhesive layer is a user applied adhesive liquid.

4. The reusable eyelash as claimed in claim 1, wherein the adhesive layer is a pre-manufactured adhesive strip.

5. A reusable eyelash comprises:
an eyelash;
a monofilament lace attachment strip;
an adhesive layer;
the eyelash comprises a base strip and a plurality of curl lashes;
the monofilament lace attachment strip comprises a front edge, a rear edge, a top surface, and a bottom surface;
the base strip being perimetrically connected along the monofilament lace attachment strip;
the base strip being adjacently positioned with the front edge; and
the adhesive layer being superimposed onto the bottom surface opposite of the eyelash.

6. The reusable eyelash as claimed in claim 5 comprises:
the plurality of curl lashes being extended along the base strip; and
the plurality of curl lashes being radially extended from the base strip.

7. The reusable eyelash as claimed in claim 5 comprises:
the front edge and the rear edge being oppositely positioned of each other along the monofilament lace attachment strip;
the top surface being oriented between the front edge and the rear edge; and
the bottom surface being oriented between the front edge and the rear edge opposite of the top surface.

8. The reusable eyelash as claimed in claim 5, wherein the monofilament lace attachment strip is a formfitting material.

9. The reusable eyelash as claimed in claim 5, wherein the adhesive layer is a user applied adhesive liquid.

10. The reusable eyelash as claimed in claim 5, wherein the adhesive layer is a pre-manufactured adhesive strip.

11. A reusable eyelash comprises:
an eyelash;
a monofilament lace attachment strip;
an adhesive layer;
the eyelash comprises a base strip and a plurality of curl lashes;
the monofilament lace attachment strip comprises a front edge, a rear edge, a top surface, and a bottom surface;
the base strip being perimetrically connected along the monofilament lace attachment strip;
the plurality of curl lashes being extended along the base strip;
the plurality of curl lashes being radially extended from the base strip;
the base strip being adjacently positioned with the front edge;
the adhesive layer being superimposed onto the bottom surface opposite of the eyelash; and
the monofilament lace attachment strip is a formfitting material.

12. The reusable eyelash as claimed in claim 11 comprises:
the front edge and the rear edge being oppositely positioned of each other along the monofilament lace attachment strip;
the top surface being oriented between the front edge and the rear edge; and
the bottom surface being oriented between the front edge and the rear edge opposite of the top surface.

13. The reusable eyelash as claimed in claim 11, wherein the adhesive layer is a user applied adhesive liquid.

14. The reusable eyelash as claimed in claim 11, wherein the adhesive layer is a pre-manufactured adhesive strip.

* * * * *